United States Patent [19]

Armstrong

[11] Patent Number: 4,547,406

[45] Date of Patent: Oct. 15, 1985

[54] METHOD FOR PRINTING INDICIA ON POROUS SHEETS

[76] Inventor: Joe W. Armstrong, 1229 E. Highland, Phoenix, Ariz. 85014

[21] Appl. No.: 476,120

[22] Filed: Mar. 17, 1983

[51] Int. Cl.[4] ..... B05D 5/00; B05D 1/32; B05D 3/12

[52] U.S. Cl. ..... 427/282; 248/362; 427/296; 427/350

[58] Field of Search ..... 427/282, 296, 294, 350; 118/301, 50; 248/363, 362

[56] References Cited

U.S. PATENT DOCUMENTS

| | | | |
|---|---|---|---|
| 2,446,010 | 7/1948 | Jahn | 118/50 X |
| 3,126,192 | 3/1964 | Stein | 248/362 |
| 3,292,532 | 12/1966 | Berk et al. | 118/301 X |
| 4,312,694 | 1/1982 | Sherman et al. | 248/363 X |

*Primary Examiner*—Evan K. Lawrence
*Attorney, Agent, or Firm*—Herbert E. Haynes, Jr.

[57] ABSTRACT

A method and apparatus for printing indicia on a porous sheet including an enclosure in which a negative static pressure is produced to cause air flow through a perforated work surface of the enclosure. The porous sheet to be printed and an overlying stencil sheet are arranged and held firmly on the perforated work surface by the negative static pressure in the enclosure. In one embodiment, all but selected areas of the perforated work surface, the porous sheet and the stencil sheet are masked to block air flow through the masked areas and concentratingly direct the air flow through the selected areas. A liquid printing medium is sprayed so that it is carried by the inflowing air onto the areas of the porous sheet which are exposed by the stencial sheet cutouts.

6 Claims, 5 Drawing Figures

METHOD FOR PRINTING INDICIA ON POROUS SHEETS

BACKGROUND OF THE INVENTION

1. Field of the Invention

This invention relates generally to printing and more specifically to a method for printing indicia on porous sheets.

2. Description of the Prior Art

The most commonly used method for printing lettering, decorative designs and other indicia on a sheet medium for making signs, posters, and the like, is to employ the well known silk-screen technique. Even though silk-screen printing is a relatively inexpensive method which can produce a fairly high quality printed product, materials costs, cutting the screen, and other set-up time and clean-up time makes it economically and otherwise unfeasible to employ the silk-screen technique where relatively few printed products are needed.

Due to this, an alternative technique is sometimes used when the number of printed products needed cannot justify the expense and the time involved in the silk-screen technique, and when the quality of the printed products need not be as good as those produced by silk-screening. The alternative technique is the well known stencil process. In one form of stenciling, the cut stencil is placed in overlaying relationship on the medium to be printed and it is sometimes held in place by masking tape while the printing material, such as ink or paint, is applied with suitable rollers or spray equipment. This basic form of stenciling is only used when the quality of the end product is of little concern in that the ink or paint will run or bleed between the medium and the stencil and cause the edges of the indicia to be unclearly defined. When a more clear indicia line definition is desired, masking tape is sometimes used about the edges of the cutout portions of the stencil to hold those edges in contiguous engagement with the medium to be printed. This can only be done when the indicia is of the simplest design and even then it is very time consuming and is no guarantee that bleeding of the printing medium will not occur.

An improved stencil method is sometimes used for producing a single printed product of improved quality, and the improvement involves the use of a special stencil material which is provided with an adhesive on one surface thereof. When the stencil is cut with the desired configuration, it is adhesively affixed to the medium to be printed and the ink or paint is applied in the usual manner. While this is an improvement over the above described stencil methods, some bleeding of the ink or paint will sometimes occur, and removal of the adhesive left behind on the printed product is often required. Further, once used, this special stencil is normally not suited for reuse in that it is oftentimes torn, or at least distorted, when removed and the adhesive is unsuitable for reuse.

Therefore, a new and useful method for printing indicia on porous sheets is needed which overcomes some of the problems and shortcomings of the prior art.

SUMMARY OF THE INVENTION

In accordance with the present invention, a new and useful method for printing indicia on porous sheets is disclosed. An apparatus for carrying out the method includes a suitable enclosure defining a vacuum chamber and having a perforated work surface. A mechanism for producing a negative static pressure, such as a centrifugal blower, is connected to, or mounted in, the vacuum chamber so as to produce an inflow of air through the perforated work surface of the enclosure. A plurality of imperforate masking means are mounted on the enclosure proximate the work surface and are adjustably positionable thereon to direct and control the inflow of air through adjustably relocatable portions of the perforated work surface. A perforated, or porous sheet to be printed is placed on the perforated work surface of the enclosure and is held firmly in contiguous engagement with the work surface of the enclosure due to the negative static pressure in the vacuum chamber thereof. A suitable imperforate stencil material, such as butcher paper, is cut in the usual manner to form the indicia representing openings therein and is placed atop the porous sheet and is held firmly in place thereon by means of the suction produced by the negative static pressure in the enclosure. When so disposed, the masking means are adjustably positioned so that air flowing into the vacuum chamber of the enclosure will only flow through the cut openings of the stencil, or adjustably selected portions thereof, and those areas of the porous sheet immediately below the cut openings.

When the porous sheet and the cut stencil are arranged in the above described manner, on the work surface of the vacuum chamber enclosure, a spray gun, or other suitable applicator is employed to spray or otherwise apply a suitable liquid printing medium, such as paint on the exposed areas of the porous sheet to be printed.

By virtue of the negative static pressure causing inflowing air which holds the porous sheet and the cut stencil in place on the work surface of the enclosure and in firm contiguous engagement with each other, and the air inflow resulting from the negative static pressure, the liquid printing medium will not bleed or run and the indicia printed on the porous sheet is of a very clear and sharp character. In addition, the cut stencil can be reused numerous times and the costs both of materials and labor are minimized. Another advantage of the present invention is that of quick drying of the printed indicia due to the inflow of air through the porous sheet in the areas which are painted or otherwise printed.

Accordingly, it is an object of the present invention to provide a new and useful method for printing indicia on porous sheets.

Another object of the present invention is to provide a new and useful method for printing indicia on a porous sheet which ideally suited for producing high quality printed products.

Another object of the present invention is to provide a new and useful method for quickly and economically printing indicia on a porous sheet with the resulted printed indicia being of sharp and clear character.

Another object of the present invention is to provide a new and useful method of the above described character wherein the apparatus used in carrying out the method includes an enclosure defining a vacuum chamber and having a perforated work surface, means for producing a negative static pressure within the enclosure so that air will flow into the enclosure through the work surface, and adjustably positionable masking means for directing and controlling the inflow of air through adjustably repositionable and variously sizeable areas of the perforated work surface.

Another object of the present invention is to provide a new and improved method of the above described character wherein the method of which includes placing a porous sheet to be printed on the perforated work surface of the vacuum chamber enclosure, placing an imperforate cut stencil on the porous sheet, adjusting the masking means so that air will flow into the vacuum chamber only through the indicia defining cutouts of the stencil, and applying a liquid printing medium on the exposed areas of the porous sheet to be printed.

The foregoing and other objects of the present invention, as well as the invention itself, may be more fully understood from the following description when read in conjunction with the accompanying drawings.

DESCRIPTION OF THE PREFERRED EMBODIMENT

Figures 1, 2, 3:
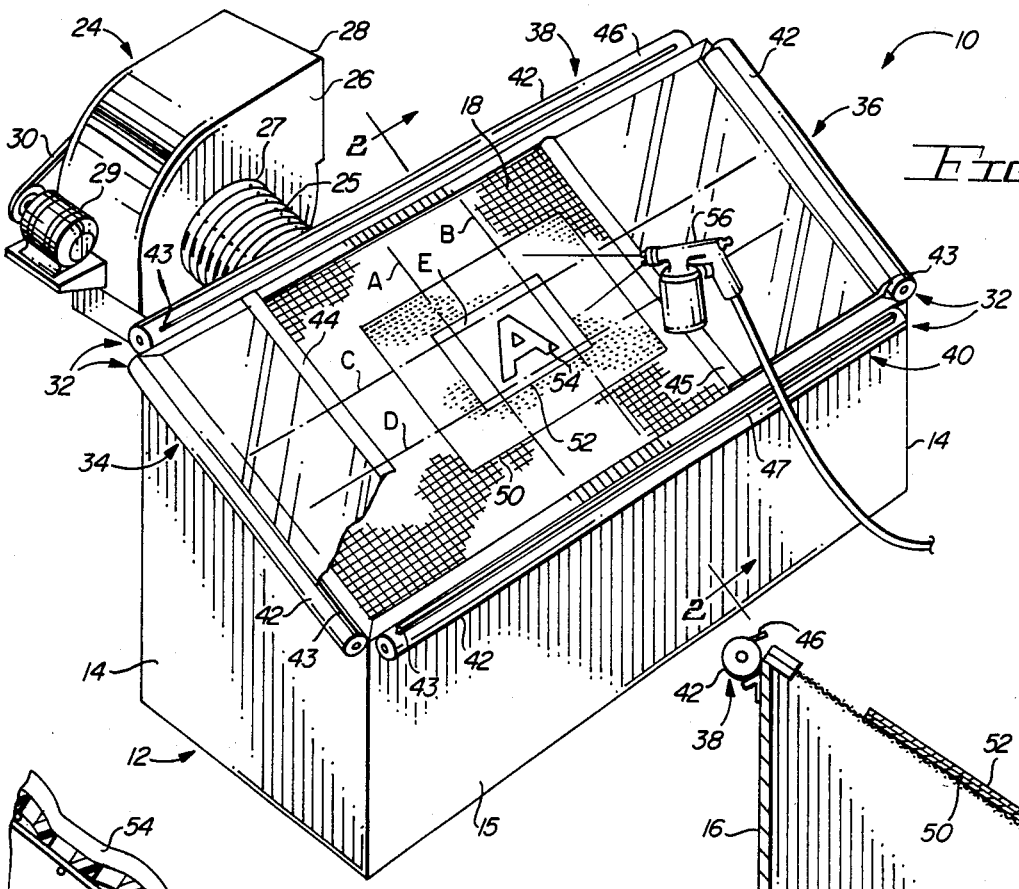
FIG. 1 is a perspective view of the apparatus useful for accomplishing the method of the present invention illustrating the various features thereof.
FIG. 2 is an enlarged sectional view taken along the line 2—2 of FIG. 1.
FIG. 3 is an enlarged fragmentary sectional view showing a portion of the vacuum chamber enclosure and the perforated work surface thereof and illustrating the positional relationship of the porous sheet to be printed, the imperforate cut stencil and the masking means.

Referring more particularly to the drawings, FIG. 1 shows the apparatus of the present invention which is indicated in its entirety by the reference numeral 10. The apparatus 10 includes a cabinet-like enclosure 12 having a floor 13, opposed sidewalls 14, front wall 15, rear wall 16, and an angularly downwardly and forwardly sloping perforated to 18 which is a work surface as will hereinafter be descrbed in detail. The floor, walls and work surface of the enclosure 12 define a vacuum chamber 20 which, as shown in FIG. 2, is provided with an air outlet fitting 22 in the rear wall 16 thereof.

An air moving means such as the illustrated centrifugal blower 24, is coupled by means of a suitable duct 25 to the outlet fitting 22, so as to extract air from the vacuum chamber 20 of the enclosure 12 and thereby produce a negative static pressure or partial vacuum therein. The centrifugal blower 24 may be of conventional configuration having a scroll-shaped housing 26 with an air inlet opening 27 in one of the sidewalls of the housing and having a centrifugal air discharge outlet 28. As is well known, a blower wheel (not shown) is rotatably mounted in the housing 26 so as to be in axial alignment with the air inlet 27 and the blower wheel may be rotatably driven by any suitable means such as the illustrated electric motor 29 which is coupled to the blower wheel by the pulley-belt arrangement 30. It will be understood that, although the centrifugal blower 24 is shown and described herein, the function of producing the negative static pressure within the enclosure 12 may be accomplished by other mechanisms such as a vacuum pump (not shown), and that the centrifugal blower 24 or its functional equivalent could be located within the vacuum chamber 20.

With a negative static pressure existing in the vacuum chamber 20 of the enclosure 12, ambient air will be drawn into the chamber 20 through the perforated top work surface 18 and will be extracted therefrom through the centrifugal blower 24 back to ambient.

The perforated top work surface 18 of the enclosure 12 is preferably a woven wire, or screen, structure having relatively large openings so as to present a minimum resistance to the inflow of air. For example, 18 gage wire woven so as to provide $\frac{1}{4}$ inch square openings has been found to provide a sufficient amount of work piece supporting rigidity with minimal resistance to air flow.

The enclosure 12 is provided with adjustable masking means 32 adjacent the top work surface 18 thereof for movement into overlaying relationship with respect to the perforated work surface 18 for adjustably closing variously selectable portions of the perforated work surface. In other words, the masking means allows the air flow to be concentrated by reducing the size of the area through which air flows into the vacuum chamber 20, and allows the open air flow area to be selectively located at any desired location on the perforated work surface 18, and allows that open area to be varied as to its size.

The masking means 32 preferably includes a pair of extensible film-roller mechanisms 34 and 36 each adjacent a different one of the side edges which define the perforated top working surface 18 and another pair of extensible film-roller mechanisms 38 and 40 adjacent the top and bottom edges, respectively, which define the perforated top work surface 18. Each of the extensible film-roller mechanisms 34, 36, 38 and 40 are structured like the well known window shade devices, and each are shown to include a cylindrical housing 42 which contains the well known spring-loaded roller mechanism (not shown) of the type commonly used in such window shade structures. The cylindrical housings 42 are each provided with an elongated slot 43 so that the masking film 44 is extensible from the roller mechanism 34 and the masking films 45, 46 and 47 are extensible from the roller mechanisms 36, 38 and 40, respectively.

The extensible masking films 44, 45, 46 and 47 may be formed of any suitable imperforate flexible material and are preferably transparent. An example of an ideally suited material is the well known commercially available product known as Mylar, which is a registered Trademark of the Dupont Company.

As is shown in FIG. 1, the masking film 44 may be extensibly moved, for example, to a dash line position identified as A, and the films 45, 46 and 47 may be similarly extended to dash line positions B, C and D, respectively. In this manner, those films will surroundingly define an area E of concentrated air inflow, and the area E may be varied in size and selectively located by simply altering the extending positions of the films as will hereinafter be more fully described.

A porous, or perforated, sheet 50 to be printed is placed in contiguous overlaying relationship on the perforated top work surface of the enclosure 12. Virtually any type of porous or perforated sheet material may be used such as woven cloth, burlap, uniformly perforated sheets of plastic, and the like. In any case, the porous sheet 50 to be printed is held firmly in place by the negative static pressure which exerts a suction on the non-porous portions of the downwardly facing surface of the porous sheet 50.

A sheet of imperforate material 52 is cut or otherwise provided with openings therein of predetermined configuration in the form of the indicia, such as that shown best at 54 in FIG. 1, which is to be printed on the porous sheet 50. Thus, the imperforate sheet material 52 having the indicia representing opening or openings formed therein is a stencil which may be made from any suitable imperforate material, such as butcher paper, and the like.

The stencil sheet 52 is placed in the desired registered relationship in overlaying contiguous engagement with the porous sheet 50 to be printed, and will be held in firm engagement therewith by the negative static pressure which exerts a suction through the pores of the sheet 50 on the downwardly facing surface of the imperforate stencil sheet 52.

With the porous sheet 50 and the imperforate stencil sheet 52 arranged as described above and the masking films 44, 45, 46 and 47 then adjustably set at the positions A, B, C and D, of FIG. 1, the inflow of air will be seen to be limited and concentrated so that it will only pass through the indicia representing opening 54 of the stencil sheet 52 and through the exposed areas of the porous sheet 50 immediately beneath the indicia opening. It will be realized that with such an arrangement, a considerable volume of air at high velocity will move through the stencil opening 54 and the exposed areas of the porous sheet 50.

A suitable printing medium such as paint, ink, or any other liquid suitable for printing is then sprayed, such as with the spray gun 56 shown in FIG. 1, so as to be airborne and thus move in the same path as the inflowing air. The sprayed liquid printing medium will thus be deposited on the non-porous portions of the exposed areas of the upper surface of the sheet to be printed and such deposition will be strictly and absolutely confined to the exposed surface areas of the porous sheet 50 so that the indicia so printed will be of very clear and sharp definition.

Figure 4:
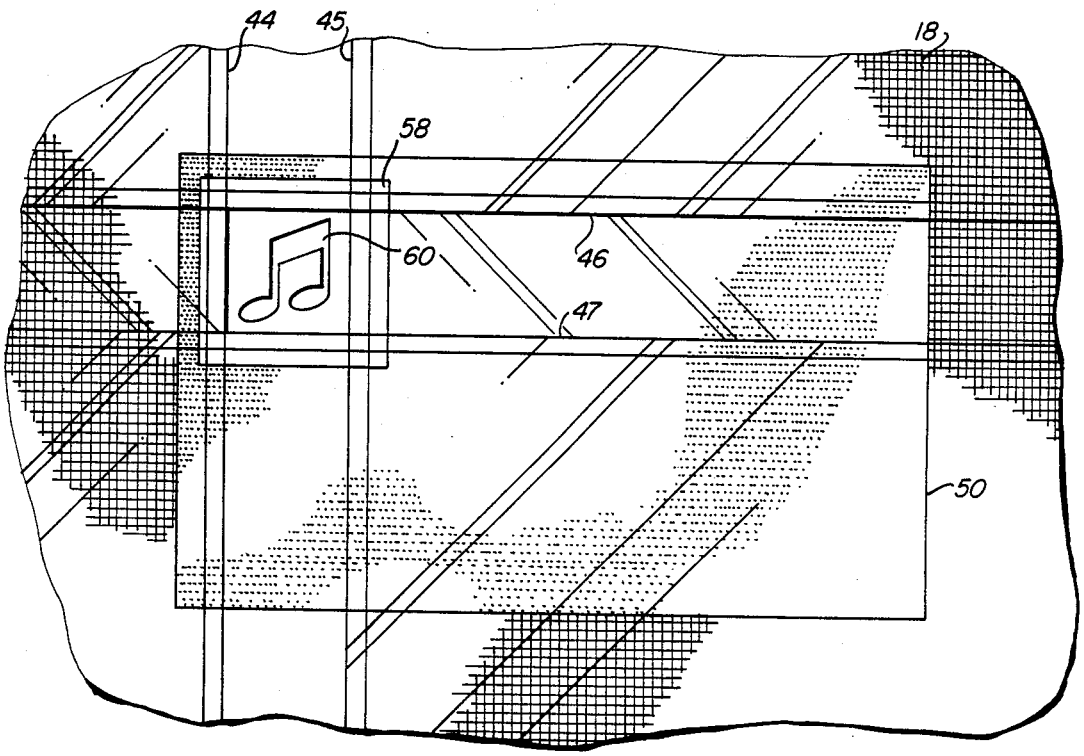
FIGS. 4 and 5 are fragmentary plan views showing the porous sheet to be printed, an imperforate cut stencil in place thereon and the adjustably repositionable masking means are shown in different positions in the two figures.
Figure 5:
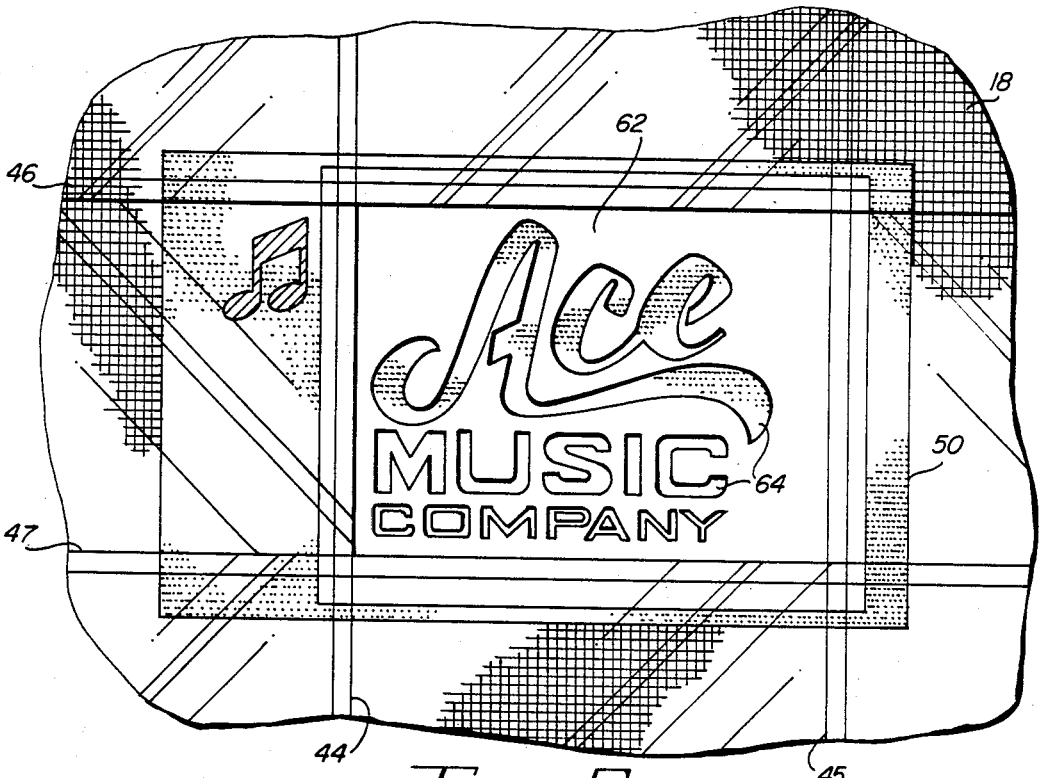

Reference is now made to FIGS. 4 and 5 which illustrate an expanded use of the apparatus of the present invention.

FIG. 4 shows the porous sheet 50 to be printed in place on the perforated top work surface 18. A stencil sheet 58 having, for example, a symbol representing opening 60 cut therein is placed on the porous sheet 50 and the masking films 44, 45, 46 and 47 are adjustably positioned so that air inflow is concentratingly limited so as to pass only through the symbol opening 60. A liquid printing medium of a given color is then sprayed so as to print indicia in the form of the symbol opening 60 on the exposed surface area of the porous sheet.

It will be appreciated that the high volume high velocity inflowing air will dry the liquid printing medium very rapidly. When the symbol indicia is dry, the stencil sheet 58 is removed and a second stencil sheet 62 having, for example, lettering representing openings 64 formed therein, is placed in the desired position on the porous sheet 50, such as is shown in FIG. 5. The masking films 44, 45, 46 and 47 are then appropriately adjusted and a liquid printing medium of, for example, a different color, is sprayed to print indicia in the form of the lettering openings 64 on the exposed surfaces of the porous sheet 50.

It will be understood that the above example is very simple in nature and could easily have been done with a single stencil sheet (not shown). However, it will be appreciated that by using the above described techniques, relatively complex multi-colored designs and/or lettering can be printed on porous sheets and such indicia can be of very high quality.

It will be further understood that the hereinbefore described apparatus 10 can be of any size or configuration as needed to produce particular printed products. For example, if very large printed products are to be made, an entire room of a building could be used to define a vacuum chamber with one wall of such a room being configured to provide the perforated work surface.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A method for printing indicia on a porous sheet comprising the steps of:

(a) producing a negative static pressure within an enclosure which has a perforated work surface to produce an air flow into said enclosure through said perforated work surface;

(b) placing a thin lightweight porous sheet to be printed on said perforated work surface so that the suction produced by the negative static pressure will hold said porous sheet in firm contiguous engagement therewith;

(c) arranging an imperforate stencil sheet having indicia representing cutouts therein on said porous sheet so that the suction produced by the negative static pressure will act through the pores of said porous sheet to firmly hold said stencil sheet in contiguous overlaying relationship therewith;

(d) masking at least the areas of said perforated work surface which remain uncovered after said porous sheet and said stencil sheet are in place on said perforated work surface to block the air flow through those uncovered areas; and (e) applying a liquid printing medium on the areas of said porous sheet which are exposed through the indicia representing cutouts of said stencil sheet.

2. A method as claimed in claim 1 wherein said step of applying a liquid printing medium is accomplished by spraying.

3. A method as claimed in claim 1 including the further step of drying the liquid printing medium subsequent to step (e) by leaving said porous sheet and said stencil sheet in the positions defined in steps b and c so that the air flowing through the areas of said porous sheet which are exposed through the indicia representing cutouts of said stencil sheet will dry the liquid printing medium applied thereon.

4. A method for printing indicia on a porous sheet comprising the steps of:

(a) producing a negative static pressure within an enclosure which has a perforated work surface to produce an air flow into said enclosure through said perforated work surface;

(b) placing a thin lightweight porous sheet to be printed on said perforated work surface so that the suction produced by the negative static pressure will hold said porous sheet in firm contiguous engagement therewith;

(c) arranging an imperforate stencil sheet having indicia representing cutouts therein on said porous sheet so that the suction produced by the negative static pressure will act through pores of said porous sheet to firmly hold said stencil sheet in contiguous overlaying relationship therewith;

(d) masking all but selected areas of said perforated work surface, said porous sheets and said stencil sheet to block air flow through the masked areas and concentratingly direct the air flow through the selected areas; and (e) applying a liquid printing medium on the unmasked selected areas of said proous sheet which are exposed through the indicia representing cutouts of said stencil sheet.

5. A method as claimed in claim 4 wherein the step of applying a liquid medium is accomplished by spraying.

6. A method as claimed in claim 4 including the further step of drying the liquid printing medium subsequent to step e by leaving said porous sheet and said stencil sheet in the positions defined in steps b and c so that the air flowing through the areas of said porous sheet which are exposed through the indicia representing cutouts of said stencil sheet will dry the liquid printing medium applied thereon.

* * * * *